US006413710B1

(12) United States Patent
Shor et al.

(10) Patent No.: US 6,413,710 B1
(45) Date of Patent: Jul. 2, 2002

(54) METHODS FOR MAKING PHOTOTHERMOGRAPHIC EMULSIONS AND IMAGING MATERIALS

(75) Inventors: Steven M. Shor, Woodbury; Chaofeng Zou, Maplewood; Sharon Simpson, Lake Elmo, all of MN (US); Stacy M. Ulrich, Dresser, WI (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/833,533

(22) Filed: Apr. 12, 2001

(51) Int. Cl.[7] ..... G03C 1/498; G03C 1/34

(52) U.S. Cl. ..... 430/569; 430/600; 430/603; 430/605; 430/611; 430/613; 430/614; 430/615; 430/619; 430/620

(58) Field of Search ..... 430/619, 600, 430/603, 611, 613, 614, 615, 569, 618, 620, 605

(56) References Cited

U.S. PATENT DOCUMENTS

| | | | | |
|---|---|---|---|---|
| 4,542,094 A | | 9/1985 | Koshizuka et al. | |
| 4,917,996 A | | 4/1990 | Matsuzaka et al. | |
| 5,922,529 A | * | 7/1999 | Tsuzuki et al. | 430/619 |
| 6,162,599 A | | 12/2000 | Vandenbroucke et al. | |

* cited by examiner

*Primary Examiner*—Thorl Chea
(74) *Attorney, Agent, or Firm*—J. Lanny Tucker; Louis M. Leichter

(57) ABSTRACT

Photothermographic emulsions and materials that are highly sensitive to imaging radiation and that provide high contrast images are provided by making the emulsions with photosensitive silver halide grains that have been formed in the presence of a hydroxytetrazaindene or an N-heterocyclic compound comprising at least one mercapto group, such as a mercapto tetrazole. Such grains can then be chemically sensitized before or after mixing with an organic silver salt using a sulfur-, tellurium-containing, or gold-containing chemical sensitizing compound, or mixtures thereof.

33 Claims, No Drawings

METHODS FOR MAKING PHOTOTHERMOGRAPHIC EMULSIONS AND IMAGING MATERIALS

FIELD OF THE INVENTION

This invention relates to a novel method for preparing photothermographic imaging emulsions and materials. In particular, it relates to a method for preparing photothermographic emulsions and imaging materials that exhibit increased photospeed, lower initial $D_{min}$, and less change in sensitometric properties upon shelf-aging.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) photosensitive catalyst (such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [Klosterboer, *Imaging Processes and Materials* (*Neblette's Eighth Edition*), Sturge, Walworth & Shepp (Eds.), Van Nostrand-Reinhold, New York, Chapter 9, pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure,* June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in situ," for example, by mixing an organic or inorganic halide-containing source with a source of reducible silver ions to achieve partial metathesis and thus causing the in situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Usanov et al., *J. Imag. Sci. Tech.* 40, 104 (1996)]. Alternatively, a portion of the reducible silver ions can be completely converted to silver halide, and that portion can be added back to the source of reducible silver ions (see Usanov et al., International Conference on Imaging Science, 7–11 September 1998)

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent for silver ion. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photo-thermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate) is used to generate the visible image using thermal development. Thus imaged, the photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermo-graphic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (Neblette's Eighth Edition), noted above, *Unconventional Imaging Processes,* E. Brinckman et al. (Eds.), The Focal Press, London and New York, 1978, pp. 74–75, in Zou et al., *J. Imaging Sci. Technol.* 1996, 40, 94–103, and in M. R. V. Sahyun, *J. Imaging Sci. Technol.* 1998, 42, 23.

Problem to be Solved

Because the developer is incorporated within the material, photothermographic materials often suffer from shelf-aging fog. Shelf-aging fog is the increase in $D_{min}$ in non-imaged areas of stored photothermographic materials. These stored unimaged materials, upon later imaging and development have a higher $D_{min}$ in non-imaged areas when compared to freshly prepared samples of the same materials that have been imaged soon after coating.

Another problem encountered in photothermography is that an increase in photospeed is often accompanied by an increase in $D_{min}$ and a loss in image contrast. This occurs in photothermographic materials that have been formulated for either continuous tone or high contrast imaging.

Yet another problem encountered in photothermography is that the photospeed and other sensitometric characteristics often change as the material ages during storage.

There is a need for methods to provide photothermographic materials with increased photospeed that can also provide either continuous tone or high contrast images while maintaining low initial $D_{min}$ as well as little change in $D_{min}$ on shelf-aging. There is also a need for photothermographic materials whose photospeed and other sensitometric characteristics undergo only little change as the material ages during storage. That is, photothermographic materials with both improved photospeed and improved shelf stability are needed.

SUMMARY OF THE INVENTION

The present invention provides a method for making a photo-thermographic emulsion comprising the steps of:

A) providing photosensitive silver halide grains that have been formed in the presence of a hydroxytetrazaindene or an N-heterocyclic compound comprising at least one mercapto group, and B) providing a photosensitive dispersion of the photosensitive silver halide grains with a non-photosensitive source of reducible silver ions.

This invention also provides a method of providing a photothermo-graphic material comprising applying the photosensitive dispersion described above as a photothermographic emulsion to a suitable support.

The present invention also provides a method for making a photothermographic emulsion comprising the steps of:

A) providing photosensitive silver halide grains that have been formed in the presence of a hydroxytetrazaindene or an N-heterocyclic compound comprising at least one mercapto group, B) providing a photosensitive dispersion of the photosensitive silver halide grains with a non-photosensitive source of reducible silver ions, and C) after step A, chemically sensitizing the photosensitive silver halide grains with at least one sulfur-containing, tellurium-containing, or gold-containing chemical sensitizing compound, or mixtures thereof.

This invention also provides a method of providing a photothermo-graphic material comprising applying the chemically-sensitized photosensitive dispersion described above as a photothermographic emulsion to a suitable support.

In one embodiment of the present invention, the method for making a photothermographic emulsion comprises the steps of, in order:

A) forming photosensitive silver halide grains in the presence of a hydroxytetrazaindene or an N-heterocyclic compound comprising at least one mercapto group, B) forming a photosensitive dispersion of the photosensitive silver halide grains with a non-photosensitive source of reducible silver ions in a non-aqueous medium, and C) chemically sensitizing the photosensitive silver halide grains with at least one sulfur-containing, tellurium-containing, or gold-containing chemical sensitizing compound, or mixtures thereof, to form a chemically sensitized photosensitive dispersion.

In another embodiment of the present invention, the method for making a photothermographic emulsion comprises the steps of:

A) forming photosensitive silver halide grains in the presence of a hydroxytetrazaindene or an N-heterocyclic compound comprising at least one mercapto group, B) forming a photosensitive dispersion of the photosensitive silver halide grains with a non-photosensitive source of reducible silver ions in a non-aqueous medium, and C) after step A and prior to step B, chemically sensitizing the photosensitive silver halide grains with at least one sulfur-containing, tellurium-containing, or gold-containing chemical sensitizing compound, or mixtures thereof.

In still another embodiment of this invention, the method for making a photothermographic emulsion comprises the steps of:

A) precipitating photosensitive silver halide grains in the presence of a hydroxytetrazaindene or an N-heterocyclic compound comprising at least one mercapto group, B) combining the photosensitive silver halide grains with a non-photosensitive source of reducible silver ions, a reducing agent for the reducible silver ions, and a hydrophobic binder to form a photosensitive dispersion, and C) after step A, chemically sensitizing the photosensitive silver halide grains with at least one sulfur-containing, tellurium-containing, or gold-containing chemical sensitizing compound, or mixtures thereof.

In yet another embodiment of the present invention, the method for making a photothermographic emulsion comprises the steps of:

A) providing photosensitive silver halide grains that have been formed in the presence of a hydroxytetrazaindene or an N-heterocyclic compound comprising at least one mercapto group, B) forming a non-photosensitive source of reducible silver ions in the presence of the photosensitive silver halide grains, thereby forming a photosensitive dispersion, and C) after step A, chemically sensitizing the photosensitive silver halide grains with at least one sulfur-containing, tellurium-containing, or gold-containing chemical sensitizing compound, or mixtures thereof.

We have discovered that photothermographic emulsions and materials prepared using the present invention have increased photospeed. Further, the photospeed and other sensitometric characteristics of these materials change little as the materials age during storage. Additionally, these materials can be formulated to provide either continuous tone or high contrast images while maintaining low initial $D_{min}$ as well as little change in $D_{min}$ on shelf-aging.

As a critical feature the invention requires that the photosensitive silver halide grains used in the emulsion be formed in the presence of tetraaza-indenes [such as a hydroxytetrazaindene] or an N-containing heterocyclic compound comprising at least one mercapto group [such as 1-phenyl-5-mercapto tetrazole (PMT)]. When silver halide grains are prepared in this way, the increased sensitivity normally provided by the use of various sulfur-, tellurium-, or gold-containing chemical sensitizing compounds is not diminished and is even enhanced in some embodiments without an undesirable increase in $D_{min}$.

While it is well known that PMT and hydroxytetrazindenes can be added to photothermographic emulsions at later stages of their preparation (for example, during chemical sensitization) or to finished emulsions, it was not previously recognized that forming the silver halide grains in their presence would provide the noted unexpected benefits in photothermographic emulsions.

DETAILED DESCRIPTION OF THE INVENTION

The photothermographic emulsions and materials prepared by this invention can be used, for example, in conventional black-and-white or color photothermography, in electronically generated black-and-white or color hardcopy recording. They can be used in microfilm applications, in radiographic imaging (for example digital medical imaging), and industrial radiography). They can also be used in the graphic arts area (for example, imagesetting and phototypesetting), in the manufacture of printing plates, and in proofing, Furthermore, the absorbance of these photothermographic materials between 350 and 450 nm is sufficiently low (less than 0.5) to permit their use in graphic arts applications such as contact printing, proofing, and duplicating ("duping"). The photothermo-graphic emulsions and materials prepared by the present invention are preferably used to obtain black-and-white images.

In the photothermographic materials, the components of the imaging layer can be in one or more layers. The layer(s) that contain a photosensitive silver halide and non-photosensitive source of reducible silver ions, or both, are referred to herein as emulsion layer(s). The photosensitive silver halide and the non-photosensitive source of reducible silver ions are in catalytic proximity and preferably in the same emulsion layer.

Various layers are usually disposed on the "backside" (non-emulsion side) of the materials, including antihalation layer(s), protective layers, antistatic layers, conducting layers, and transport enabling layers.

Various layers are also usually disposed on the "frontside" or emulsion side of the support, including protective topcoat layers, primer layers, interlayers, opacifying layers, antistatic layers, antihalation layers, acutance layers, auxiliary layers, and others readily apparent to one skilled in the art.

The process for the formation of a visible image (usually a black-and-white image) comprises first exposing to electromagnetic radiation and thereafter heating the photothermographic material. Thus, the imaging process generally comprises:

A) imagewise exposing the photothermographic material to electromagnetic radiation to which the photosensitive silver halide of the material is sensitive, to generate a latent image, and B) simultaneously or sequentially, heating the exposed material to develop the latent image into a visible image.

In some other embodiments, the imaging method further comprises.

C) positioning the exposed material with a visible image thereon between a source of imaging radiation and an imageable material that is sensitive to the imaging radiation, and D) thereafter exposing the imageable material to the imaging radiation through the visible image in the exposed and developed photothermographic material to provide a visible image in the imageable material.

This visible image can also be used as a mask for exposure of other photosensitive imageable materials, such as graphic arts films, proofing films, printing plates and circuit board films, that are sensitive to suitable imaging radiation (for example UV radiation). This can be done by imaging an imageable material (such as a photopolymer, a diazo material, a photoresist, or a photosensitive printing plate) through the exposed and heat-developed photothermographic material using steps C) and D) noted above.

When the photothermographic materials are heat-developed as described below in a substantially water-free condition after, or simultaneously with, imagewise exposure, a silver image (preferably a black-and-white silver image) is obtained. The photothermographic material may be exposed in step A using ultraviolet, visible, infrared or laser radiation using an infrared laser, a laser diode, an infrared laser diode, a light-emitting screen, a CRT tube, a light-emitting diode, or other light or radiation source readily apparent to one skilled in the art.

Definitions

As used herein:

In the descriptions of the photothermographic materials prepared from the practice of the present invention, "a" or "an" component refers to "at least one" of that component.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process,* Fourth Edition, Macmillan 1977, p. 374.

"Photothermographic material(s)" means a construction comprising at least one photothermographic emulsion layer or a photothermographic set of layers (wherein the photosensitive silver halide and the non-photosensitive source of reducible silver ions are in one layer and the other components or additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Photothermographic emulsion" or "emulsion" refers to a dispersion that comprises as essential components: at least one photosensitive silver halide and at least one non-photosensitive source of reducible silver ions. As is well known in the art, the emulsion can include many other components and addenda that described in more detail below.

"Emulsion layer", "imaging layer", or "photothermographic emulsion layer" means a layer of a photothermographic material that contains the photosensitive silver halide and non-photosensitive source of reducible silver ions. It can also mean a layer of the photothermographic material that contains, in addition to the photosensitive silver halide and/or non-photosensitive source of reducible ions, additional components or additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 750 nm.

"Short wavelength visible region of the spectrum" refers to that region of the spectrum of from about 400 nm to about 450 nm.

"Red region of the spectrum" refers to that region of the spectrum of from about 600 nm to about 750 nm.

"Infrared region of the spectrum" refers to that region of the spectrum of from about 750 nm to about 1400 nm.

"Non-photosensitive" means not intentionally light sensitive.

The sensitometric terms "photospeed" or "photographic speed" (also known as "sensitivity"), "contrast", $D_{min}$, and $D_{max}$ have conventional definitions known in the imaging arts.

"Transparent" means capable of transmitting visible light or imaging radiation without appreciable scattering or absorption.

As is well understood in this art, for the various compounds described herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy and the like. For example, alkyl group includes ether and thioether groups (for example $CH_3$—$CH_2$—$CH_2$—O—$CH_2$— or $CH_3$—$CH_2$—$CH_2$—S—$CH_2$—), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y 10011).

Other aspects, advantages, and benefits of the present invention are apparent from the detailed description, examples, and claims provided in this application.

Preparation of Photothermographic Emulsions

This section describes in more detail the method of the present invention for making photothermographic emulsions. The hydroxytetrazaindenes and mercapto-substituted N-heterocyclic compounds essential for this method are also described herein, but other necessary components, for example the photosensitive silver halides, chemical sensitizing compounds, and non-photosensitive sources of reducible silver ions are described in more detail in following sections.

An essential feature of the present invention is that the photosensitive silver halides used to make up the photothermographic emulsions must be prepared in the presence of one or more hydroxytetrazaindenes and mercapto-substituted N-heterocyclic compounds as defined below. This feature is encompassed by step A of the present invention. The photosensitive silver halides can be prepared in this manner at any time prior to carrying out additional method steps. While the photosensitive silver halides can be prepared in advance by the same or different artisan, typically the artisan preparing the photothermographic emulsion also will likely prepare the photosensitive silver halides in the presence of the noted essential compounds. Generally, the photosensitive silver halide grains are prepared in an ex situ manner and are what are known in the art as "preformed" grains.

Such preformed silver halide grains can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)]. Other techniques for making such photosensitive silver halide grains are provided in *Research Disclosure,* September 1974, Item 12537.

The photosensitive silver halide grains can be prepared by mixing a solution of a silver(I) source and a solution of halide source in the presence of a hydroxytetraazaindene or a mercapto-substituted N-heterocyclic compound. The hydroxytetraazaindene or a mercapto-substituted N-heterocyclic compound can be present in the silver source solution, in the halide source solution, or in solution in the reaction vessel prior to the addition of the silver source and halide source solutions. If desired, the hydroxytetraazaindene or a mercapto-substituted N-heterocyclic compound can be added as a separate solution during the addition of the silver source and halide source solutions.

The hydroxytetraazaindene or mercapto-substituted N-heterocyclic compounds do not have to be present during the entire course of the addition of the silver source and halide source solutions addition. That is, they can be present during the formation of only a portion of the silver halide grains. For example, in the formation of "core-shell" silver halide grains, the hydroxytetraazaindene or mercapto-substituted N-heterocyclic compound can be present during the formation of only the core or of only the shell. As noted above, the hydroxytetraazaindene or mercapto-substituted N-heterocyclic compound may also be added throughout the formation of the entire core-shell grains.

The advantages of this invention are provided by the addition of at least $10^{-5}$ mol/mol of silver halide (preferably from about $10^{-3}$ to about $3\times10^{-3}$ mol/mol of silver halide) of one or more hydroxytetrazaindenes, one or more mercapto-substituted N-heterocyclic compounds, or one or more of both types of compounds, particularly during the precipitation step.

Hydroxytetrazaindenes that can be used in the practice of this invention, alone or in combination, can be represented by any of the following Structures INDENE-1, INDENE-2, INDENE-3 INDENE-4, INDENE-5 INDENE-6, or INDENE-7:

INDENE-1

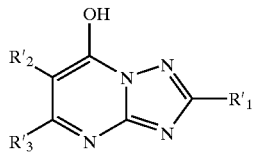

INDENE-2

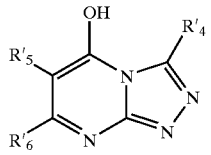

INDENE-3

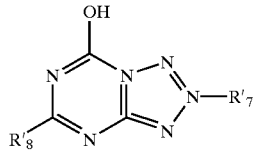

INDENE-4

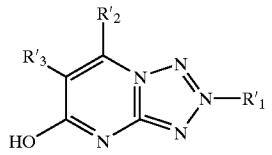

INDENE-5

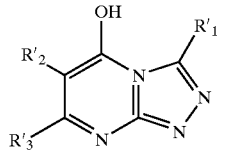

-continued

INDENE-6

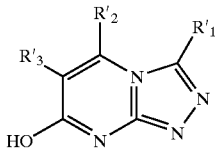

INDENE-7

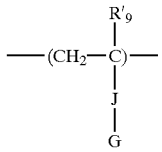

wherein $R'_1$ to $R'_9$ are independently hydrogen, a substituted or unsubstituted aliphatic group such as a substituted or unsubstituted alkyl group (for example, methyl, hydroxymethyl, ethyl, n-propyl, n-pentyl, n-hexyl, n-octyl, iso-propyl, sec-butyl, t-butyl, methoxymethyl, 2-methoxyethyl, 3-ethoxypropyl or 4-methoxy-butyl, benzyl, phenethyl, benzhydryl, 1-naphthylmethyl, and 3-phenylbutyl), a substituted or unsubstituted cycloalkyl group (such as cyclohexyl, cyclopentyl-methyl, and 2-norbonyl), a carbonyl or alkoxycarbonyl group [such as hydroxy-methyl, 2-hydroxymethyl, 3-hydroxybutyl, carboxymethyl, 2-carboxyethyl, and 2-(methoxycarbonyl) ethyl], or a substituted or unsubstituted aryl group [such as phenyl, 4-hydroxyphenyl, 1-naphthyl, p-tolyl, m-ethylphenyl, m-cumenyl, mesityl, 2,3-xylyl, p-chlorophenyl, o-bromophenyl, p-hydroxyphenyl, 1-hydroxy-2-naphthyl, m-methoxyphenyl, p-ethoxyphenyl, p-carboxyphenyl, o-(methoxy-carbonyl)phenyl, m-(ethoxycarbonyl)phenyl, and 4-carboxy-1-naphthyl].

Preferably, $R'_1$ to $R'_9$ are independently hydrogen, an alkyl group of from one to four carbon atoms or a phenyl group.

In INDENE-7, G represents a monovalent group formed by eliminating one hydrogen atom from the compounds represented by the formulae INDENE-1 INDENE-2, INDENE-3, INDENE-4, INDENE-5, and INDENE-6 (for example, those formed by eliminating one hydrogen atom from $R'_1$ to $R'_8$ or from the OH group).

In INDENE-7, J represents a divalent linking group (for example, divalent aliphatic, divalent cyclic, or combinations of divalent aliphatic and divalent cyclic groups). Preferred divalent linking groups include, but are not limited to, —$CONHCH_2$—, —$CONHCH_2CH_2$—, —$CONHCH_2OCOCH_2$—, —$CONHCH_2CH_2CH_2OCOCH_2$—, —$COOCH_2$—, —$COOCH_2CH_2$—, —$COOCH_2CH_2OCOCH_2$—, —$COOCH_2CH_2CH_2OCOCH_2$—, and —$C_6H_4$—$NHCOCH_2$—.

The compound having the units represented by INDENE-7 may be either a homopolymer or a copolymer, and the copolymer may include, for example, a copolymer of monomers such as acrylamide, methacrylamide, an acrylate, or a methacrylate.

Representative hydroxytetrazaindenes useful in the practice of this invention include:

X-1 4-hydroxy-6-methyl-1,3,3a,7-tetrazaindene,

X-2 4-hydroxy-6-phenyl-1,3,3a,7-tetrazaindene,

X-3 4-methyl-6-hydroxy-1,3,3a,7-tetrazaindene,

X-4 2,6-dimethyl-4-hydroxy-1,3,3a,7-tetrazaindene,

X-5 4-hydroxy-5-ethyl-6-methyl-1,3,3a,7-tetrazaindene,

X-6 2,6-dimethyl-4-hydroxy-5-ethyl-1,3,3a,7-tetrazaindene,

X-7 4-hydroxy-5,6-dimethyl-1,3,3a,7-tetrazaindene,

X-8 4-hydroxy-6-methyl-1,2,3a,7-tetrazaindene,

X-9 4-hydroxy-6-phenyl-1,2,3a,7-tetrazaindene,

X-10 4-hydroxy-1,2,3a,7-tetrazaindene, and

X-11 4-methyl-6-hydroxy-1,2,3a,7-tetrazaindene.

Compound X-1 is preferred.

Useful mercapto-substituted N-heterocyclic compounds are those having at least one mercapto group substituted on a nitrogen-containing heteroring that is selected from among imidazoline, imidazole, imidazolone, pyrazoline, pyrazole, pyrazolone, oxazoline, oxazole, oxazolone, thiazoline, thiazole, thiazolone, selenazoline, selenazole, selenazolone, oxadiazole, thiadiazole, triazole, tetrazole, benzoimidazole, benzotriazole, indazole, benzoxazole, benzothiazole, benzoselenazole, pyridine, pyrimidine, pyridazine, triazine, oxazine, thiazine, tetrazine, quinazoline, phthalazine, and polyazaindene (for example, triazaindene, tetrazaindene or pentazaindene) rings. These rings can be further substituted if desired, with additional mercapto groups, alkyl groups, aryl groups, or other groups that would be readily apparent to one skilled in the art.

More particularly, these compounds can be represented by the following Structure HETERO:

HETERO

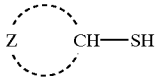

wherein Z represents at least one nitrogen atom and other atoms necessary to form a 5- to 7-membered ring as described above that can be further substituted. Preferably, Z represents nitrogen and carbon atoms necessary to provide a diazole, triazole, or tetrazole ring that can be further substituted, and more preferably, it represents the nitrogen atoms necessary to form a tetrazole ring that can be further substituted.

Representative mercapto mercapto-substituted N-heterocyclic compounds useful in the practice of this invention include:

Y-1 1-phenyl-5-mercaptotetrazole,

Y-2 1-ethyl-5-mercapto-tetrazole,

Y-3 1-ethyl-5-mercapto-tetrazole,

Y-4 3-phenyl-5-mercapto-1,2,4-triazole,

Y-5 3-mercapto-5-acetylamido-1,2,4-triazole,

Y-6 3-mercapto-4-methyl-5-acetylamino-1,2,4-triazole,

Y-7 4-amino-5-mercapto-1,2,4-triazole,

Y-8 2-mercapto-5-amino-1,3,4-thiadiazole,

Y-9 1-hydroxy-2-mercapto-4-methylpyrimidine,

Y-10 2-mercapto-1,3,4-thiadiazole, and

Y-11 1-benzoylamino-2-mercapto-5-phenyl-1,3,4-triazole.

Compound Y-1 is preferred.

There are a number of embodiments of the present invention that can be envisioned based on the teaching presented herein. Thus, the present invention is not to be limited to the few preferred embodiments that are generally defined herein, or illustrated in the examples presented below.

For example, in one preferred embodiment of the invention, step A is carried out by forming the photosensitive silver halide grains in the presence of a hydroxytetrazaindene or mercapto-substituted N-heterocyclic compound as described above, following by step B wherein a photosensitive dispersion is formed with those grains and a non-photosensitive source of reducible silver ions in a non-aqueous environment. The photosensitive silver halide grains are optionally then chemically sensitized (step C) using one or more chemical sensitizing compounds as described below.

Such a non-aqueous environment generally includes one or more hydrophobic binders (as defined below) and one or more polar organic solvents that are commonly used to prepare photothermographic emulsions. Such solvents include, but are not limited to, alcohols (such as ethanol), ketones [such as acetone and methyl ethyl ketone (MEK)], tetrahydrofuran, and toluene. MEK is the preferred solvent.

This preferred embodiment can be more specifically defined wherein:

a) forming the photosensitive silver halide grains as described above, for example, by precipitation in the presence of a hydroxytetrazaindene or a mercapto-substituted N-heterocyclic compound as described above, b) forming the mixture of photosensitive silver halide grains and non-photosensitive reducible silver source by precipitating the non-photosensitive reducible silver source in the presence of the silver halide grains to form a "preformed soap,"

c) combining the resulting preformed soap with a binder (particularly a hydrophobic binder) and an organic solvent and dispersing the mixture to form a photosensitive silver soap dispersion, (conventional dispersing techniques such as homogenization or bead milling can be used to reduce the particle size in forming the dispersion), and d) adding one or more chemical sensitizing compounds to the photosensitive dispersion.

Spectral sensitization and addition of other conventional components (for example, antifoggants, toners, and reducing agents) can be carried out simultaneously with chemical sensitization, or preferably thereafter. The same or different hydroxytetrazaindene or mercapto-substituted N-heterocyclic compound can be added at any time after the photosensitive dispersion is formed. For example, it may be added during chemical sensitization, or during or after spectral sensitization. A "finished wet" photothermographic emulsion is thereby provided for application to a suitable support (defined below).

The noted embodiment can be varied by chemically sensitizing the photosensitive silver halide grains before the "preformed soap process", or immediately thereafter, and before the organic silver salt is formed.

Thus, it is essential that at least some of the photosensitive silver halides be preformed and prepared by an ex-situ process. The silver halide grains prepared ex-situ may then be added to and physically mixed with the non-photosensitive source of reducible silver ions, as described above. It is more preferable to form the source of reducible silver ions in the presence of preformed silver halide. In this process, the source of reducible silver ions, such as a long chain fatty acid silver carboxylate (commonly referred to as silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

It is also possible to have a mixture of ex situ and in situ photosensitive silver halide grains. Thus, a preformed soap can be prepared using preformed silver halide grains that have been formed in the presence of a hydroxytetrazaindene or mercapto-substituted N-heterocyclic compound, but a halide-containing compound can then be added to the emulsion to partially convert the silver of the organic silver salt to silver halide. The halogen-containing compound can be inorganic (such as zinc bromide or lithium bromide) or organic (such as N-bromosuccinimide).

The Photosensitive Silver Halide

As noted above, the photothermographic emulsions and materials prepared by the present invention include one or more photosensitive silver halides such as silver bromide, silver iodide, silver chloride, silver bromoiodide, silver chlorobromoiodide, silver chlorobromide, and others readily apparent to one skilled in the art. Mixtures of photosensitive silver halides can also be used in any suitable proportion. Silver bromide and silver bromoiodide are more preferred, with the latter silver halide having up to 10 mol % silver iodide. Typical techniques for preparing and precipitating these silver halide grains are described in *Research Disclosure,* 1978, item 17643.

The shape of the photosensitive silver halide grains used in the present invention is in no way limited. The silver halide grains may have any crystalline habit including, but not limited to, cubic, octahedral, rhombic dodecahedral, orthorhombic, tetrahedral, other polyhedral, laminar, twinned, platelet, or tabular morphologies and may have epitaxial growth of crystals thereon. If desired, a mixture of these crystals can be employed. Silver halide grains having cubic and tabular morphology are preferred.

The photosensitive silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.) incorporated herein by reference. Iridium and/or copper doped core-shell and non-core-shell grains are described in U.S. Pat. No. 5,434,043 (Zou et al.) and U.S. Pat. No. 5,939,249 (Zou), incorporated herein by reference.

The photosensitive silver halide grains used in the present invention can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process,* Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

The one or more photosensitive silver halides used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

Chemical and Spectral Sensitizers

As noted above, the photosensitive silver halides used in the present invention can be, and preferably are, chemically sensitized in a suitable manner using one or more chemical sensitizing compounds, at least one of which is a sulfur-containing, tellurium-containing, or gold-containing chemical sensitizing compound.

Thus, the photothermographic material may be chemically sensitized with various chemical sensitizing compounds containing sulfur, selenium, tellurium, gold, platinum, palladium, ruthenium, rhodium, iridium, or combinations thereof, a reducing agent such as a tin halide or a combination of any of these, as long as one of the compounds contains sulfur, tellurium, or gold. The details of these procedures are described in T. H. James, *The Theory of the Photographic Process,* Fourth Edition, Chapter 5, pp. 149–169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915 371 (Lok et al.).

In addition, mixtures of chemical sensitizing compounds can be used to advantage in the present invention. For example, two or more sulfur-containing, tellurium-containing, or gold-containing chemical sensitizer compounds can be used. Moreover, mixtures of compounds from two or more of each class of chemical sensitizing compounds can be used. For example, a mixture of sulfur-containing chemical sensitizing compounds with tellurium-containing chemical sensitizing compounds can be used, or a mixture gold-containing chemical sensitizing compounds with either or both sulfur-containing and tellurium-containing chemical sensitizing compounds can be used.

Various gold(I) compounds, such as those described in U.S. Pat. No. 5,858,637 (Eshelman et al.), can also be used as chemical sensitizing compounds in photothermographic compositions and materials prepared as described herein.

In one preferred embodiment, at least one gold(III)-containing chemical sensitizing compound (as defined below) is used in a mixture with at least one sulfur-containing chemical sensitizing compound or at least one tellurium-containing chemical sensitizing compound.

Particularly useful tellurium-containing chemical sensitizing compounds are described in copending U.S. Ser. No.09/746,400 (filed Dec. 21, 2000 by Lynch, Opatz, Shor, Simpson, Willett, and Gysling), incorporated herein by reference, and can be represented by the following Structure I, II, or III:

I

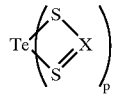

$$Te(L)_m(X^1)_n \quad \text{II}$$

$$Pd(X^2)_2[Te(R')_2]_2 \quad \text{III}$$

In Structure I, X represents a COR, CSR, $CN(R)_2$, CR, $P(R)_2$ or $P(OR)_2$ group that is attached to the two sulfur atoms through the noted carbon or phosphorus atom in the groups. Preferably, X represents a COR, CSR, $CN(R)_2$, $P(R)_2$, or $P(OR)_2$ group, and more preferably X is a $CN(R)_2$ group.

The "R" groups used to define "X" can be any suitable substituted or unsubstituted alkyl group having 1 to 20 carbon atoms (including all possible isomers, such as methyl, ethyl, isopropyl, t-butyl, octyl, decyl, trimethylsilylmethyl, and 3-trimethylsilyl-n-propyl), substituted or unsubstituted alkenyl group having 2 to 20 carbon atoms (including all possible isomers such as ethenyl, 1-propenyl, and 2-propenyl) or substituted or unsubstituted carbocyclic or hetero-cyclic aryl group (Ar) having 6 to 10 carbon atoms in the single- or fused-ring system [such as phenyl, 4-methylphenyl, anthryl, naphthyl, p-methoxyphenyl, 3,5-dimethylphenyl, p-tolyl, mesityl, pyridyl, xylyl, indenyl, 2,4,6-tri(t-butyl)-phenyl, pentafluorophenyl, p-methoxyphenyl and 2-phenylethyl]. Preferably, R is a substituted or unsubstituted alkyl group having 1 to 8 carbon atoms such as trimethylsilylethyl, and 3-trimethylsilyl-n-propyl.

Also in Structure I, p is 2 or 4, and preferably, it is 2.

In Structure II, L represents the same or different ligand derived from a neutral Lewis base such as ligands derived from thiourea, substituted thiourea, pyridine, and substituted pyridine groups. Preferably, L is a ligand derived from thiourea or a substituted thiourea, and more preferably, it is a ligand derived from a thiourea as defined below in relation to Structure IV, V, or VI.

$X^1$ represents a halo (such as chloro, bromo, or iodo), OCN, SCN, $S_2CN(R)_2$, $S_2COR$, $S_2CSR$ $S_2P(OR)_2$, $S_2P(R)_2$, SeCN, TeCN, CN, SR, OR, $N_3$, alkyl (as defined above for R), aryl (as defined above for R), or $O_2CR$ group wherein R is as defined above. Preferably, $X^1$ represents a halo (such as chloro or bromo), SCN, or $S_2CN(R)_2$ group, and more preferably, it represents a halo group such as chloro or bromo.

Also in Structure II, m is 0, 1, 2, or 4, and n is 2 and 4 provided that when m is 0 or 2, n is 2 or 4. However, when m is 0 or 2, n is 2 or 4, and when m is 1 or 4, n is 2. Preferably, m is 2 and n is 2 or 4.

In Structure III, $X^2$ represents a halo, OCN, SCN, $S_2CN(R)_2$, $S_2COR$, $S_2CSR$ $S_2P(OR)_2$, $S_2P(R)_2$, SeCN, TeCN, CN, SR, OR, $N_3$, alkyl (as defined above for R), aryl (as defined above for Ar), or $O_2CR$ group (in which R is as defined above). Preferably, $X^2$ represents a halo, SCN, or SeCN group. More preferably, $X^2$ is a chloro, bromo, or SCN group.

In addition, R' represents a substituted or unsubstituted alkyl or aryl group that is defined as described above for R. Preferably, R' is a substituted or unsubstituted alkyl groups having from 1 to 10 carbon atoms.

Particularly useful sulfur-containing chemical sensitizing compounds are substituted thiourea ligands that include any —S═C(—N<)—N< group that has one or more of the two remaining valences on each nitrogen atom substituted with hydrogen or with the same or different aliphatic substituents. More preferably, the four nitrogen valences are substituted with the same aliphatic substituent. Such useful thioureas are described for example in U.S. Pat. No. 5,843,632 (Eshelman et al.), incorporated herein by reference and in U.S. Ser. No. 09/667,748 (filed Sep. 21, 2001 by Lynch, Simpson, Shor, Willett, and Zou), incorporated herein by reference.

In general, these compounds can be represented by the following Structure IV, V, or VI:

IV

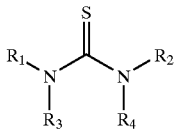

V

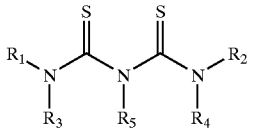

VI

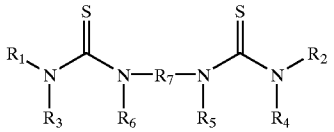

In Structure IV, $R_1$, $R_2$, $R_3$, and $R_4$ independently represent hydrogen, substituted or unsubstituted alkyl groups (including alkylenearyl groups such as benzyl), substituted or unsubstituted aryl groups (including arylenealkyl groups), substituted or unsubstituted cycloalkyl groups, substituted or unsubstituted alkenyl groups, substituted or unsubstituted alkynyl groups and heterocyclic groups.

Useful alkyl groups are branched or linear and can have from 1 to 20 carbon atoms (preferably having 1 to 5 carbon atoms), useful aryl groups can have from 6 to 14 carbon atoms in the carbocyclic ring, useful cycloalkyl groups can have from 5 to 14 carbon atoms in the central ring system, useful alkenyl and alkynyl groups can be branched or linear and have from 2 to 20 carbon atoms, and useful heterocyclic groups can have 5 to 10 carbon, oxygen, sulfur and nitrogen atoms in the central ring system (they can also have fused rings).

These various monovalent groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, carboxylic acid groups, sulfonic acid groups, hydroxylamino groups, sulfo groups, phosphono groups, and any other group readily apparent to one skilled in the art. $R_1$, $R_2$, $R_3$, $R_4$ and $R_5$ can independently be alkyl groups.

Alternatively, $R_1$ and $R_3$ taken together, $R_2$ and $R_4$ taken together, $R_1$ and $R_2$ taken together, or $R_3$ and $R_4$ taken together, can form a substituted or unsubstituted 5- to 7-membered heterocyclic ring.

Where $R_1$ and $R_3$ are taken together or $R_2$ and $R_4$ are taken together, the heterocyclic rings can be saturated or unsaturated and can contain oxygen, nitrogen or sulfur atoms in addition to carbon atoms. Useful rings of this type include, but are not limited to, imidazole, pyrroline, pyrrolidine, thiohydantoin, pyridone, morpholine, piperazine and thiomorpholine rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), alkoxy groups, carbonyloxyester groups, halo groups, cyano groups, hydroxy groups, acyl groups, alkoxycarbonyl groups, sulfonic ester groups, alkylthio groups, carbonyl groups, carboxylic acid groups, sulfonic acid groups, hydroxylamino groups,, sulfo groups, phosphono groups, and other groups readily apparent to one skilled in the art.

Where $R_1$ and $R_2$ are taken together or $R_3$ and $R_4$ are taken together, the heterocyclic rings can be saturated or unsaturated and can contain oxygen, nitrogen or sulfur atoms in addition to carbon atoms. Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5,-triazine-2(1H)-thione, dihydro-2-thioxo-4,6-(1H,3H)-pyrimidinedione, dihydro-1,3,5-triazine-2,4-(1H, 3H)-dione and hexahydro-diazepine-2-thione rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), carbonyloxyester groups, halo groups, cyano groups, hydroxy groups, acyl groups, alkoxycarbonyl groups, sulfonic ester groups, alkylthio groups, carbonyl groups, alkoxy groups carboxylic acid groups, sulfonic acid groups, hydroxylamino groups, sulfo groups, phosphono groups, and other groups readily apparent to one skilled in the art.

Preferably, $R_1$, $R_2$, $R_3$, and $R_4$ independently represent alkyl, alkenyl, alkynyl, aryl, and heterocyclic groups, more preferably alkyl, aryl, and alkenyl groups, and most preferably alkenyl groups. A preferred alkenyl group is an allyl group. A preferred alkyl group is a methyl group. Also particularly useful are sulfur-containing 1,1,3,3-tetrasubstituted thiourea compounds having carboxylic acid groups, sulfonic acid groups, or other acid groups that have an acid dissociation constant (pKa) of less than 7.

In Structure V noted above, $R_1$, $R_2$, $R_3$, $R_4$ and $R_5$ have the same definitions as noted above for $R_1$, $R_2$, $R_3$ and $R_4$ in Structure I with the following differences:

$R_1$ and $R_3$ can be taken together, $R_2$ and $R_4$ can be taken together, $R_3$ and $R_5$ can be taken together and/or $R_4$ and $R_5$ can be taken together, to form substituted or unsubstituted 5- to 7-membered heterocyclic rings (as described above for Structure IV). When those heterocyclic rings are formed from $R_1$ and $R_3$ taken together or $R_2$ and $R_4$ taken together, they are as defined above for $R_1$ and $R_3$ taken together for Structure I, but the resulting heterocyclic rings can have other substituents such as alkoxy groups, dialkylamino groups, and carboxylic acid groups, sulfonic acid groups, hydroxylamino groups, sulfo, phosphono and other acidic groups. When those heterocyclic rings are formed from $R_3$ and $R_5$ taken together or $R_4$ and $R_5$ taken together, they can be substituted as described for $R_1$ and $R_3$ of Structure IV. Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5,-triazine-2(1H)-thione, dihydro-2-thioxo-4,6-(1H, 3H)-pyrimidinedione, dihydro-1,3,5-triazine-2,4-(1H, 3H)-dione and hexahydrodiazepine-2-thione.

For Structure V, the preferred groups for $R_1$–$R_5$ are hydrogen, alkyl, alkenyl, alkynyl, aryl, and heterocyclic groups, more preferably alkyl, aryl, and alkenyl groups, and more preferably alkenyl groups. A preferred alkenyl group is an allyl group.

Also, in Structure V, most preferable alkyl groups are methyl and ethyl groups. Most preferable aryl groups are phenyl or tolyl groups. Most preferable cycloalkyl groups are cyclopentyl and cyclohexyl groups. Most preferably the alkenyl group is an allyl group. Most preferable heterocyclic groups are morpholino and piperazino groups.

In Structure VI noted above, $R_1$, $R_2$, $R_3$, $R_4$, $R_5$, and $R_6$ have the same definitions as noted above for $R_1$, $R_2$, $R_3$, $R_4$, and $R_5$ in Structure V described above. In addition, $R_3$ and $R_6$ taken together, R4 and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring as described above for the heterocyclic rings in Structure V.

$R_7$ is a divalent aliphatic or alicyclic linking group including but not limited to substituted or unsubstituted alkylene groups having 1 to 12 carbon atoms, substituted or unsubstituted cycloalkylene groups having 5 to 8 carbon atoms in the ring structure, substituted or unsubstituted arylene groups having 6 to 10 carbon atoms in the ring structure, substituted or unsubstituted divalent heterocyclyl groups having 5 to 10 carbon, nitrogen, oxygen, and sulfur atoms in the ring structure, or any combination of two or more of these divalent groups, or any two or more of these groups connected by ether, thioether, carbonyl, carbonamido, sulfoamido, amino, imido, thiocarbonyl, thioamido, sulfinyl, sulfonyl, or phosphinyl groups. Preferably, $R_7$ is a substituted or unsubstituted alkylene group having at least 2 carbon atoms.

Another particularly useful method of chemical sensitization is by oxidative decomposition of a sulfur-containing spectral sensitizing dye in the presence of a photothermographic emulsion, as described in U.S. Pat. No. 5,891,615 (Winslow et al.), incorporated herein by reference. For example, chemical sensitization can be carried out using a sulfur-containing compound containing a thiohydantoin, rhodanine, or 2-thio-4-oxo-oxazolidine nucleus that is represented by the following Structure VII, VIII, or IX:

VII

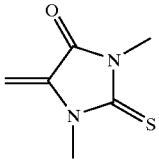

VIII

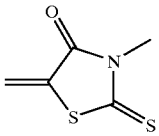

IX

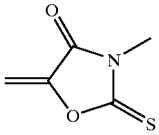

Sulfur-containing chemical sensitizing compounds useful in the present invention are well known in the art and described for example, in Sheppard et al., *J. Franklin Inst.,* 1923, 196, pp. 653 and 673, C. E. K. Mees and T. H. James, *The Theory of the Photographic Process,* 4th Edition, 1977, pp. 152–3, Tani, T., *Photographic Sensitivity: Theory and Mechanisms,* Oxford University Press, N.Y., 1995, pp. 167–176, Zavlin et al., IS&T's 48th Annual Conference Papers, May 7–11 1995 Washington D.C., pp. 156–6, U.S. Pat. No. 4,810,626 (Burgmaier et al.), U.S. Pat. No. 4,036,650 (Kobayashi et al.), U.S. Pat. No. 4,213,784 (Ikenoue et al.), and U.S. Pat. No. 4,207,108 (Hiller).

As noted above, in some embodiments of this invention, it is desirable to obtain high photographic speed using combinations of sulfur- and/or tellurium-containing chemical sensitizing compounds described above with one or more gold-containing chemical sensitizing compounds. Preferred gold-containing chemical sensitizing compounds are gold (III)-containing chemical sensitizing compounds described in copending and commonly assigned U.S. Ser. No. 09/768,094 (filed Jan. 24, 2001 by Simpson, Whitcomb, and Shor), incorporated herein by reference. Such gold(III)-containing compounds useful in the practice of this invention are represented by the following Structure GOLD:

$$Au(III)L'_rY_q$$

GOLD wherein L' represents the same or different ligands, each ligand comprising at least one heteroatom that is capable of forming a bond with gold, Y is an anion, r is an integer of from 1 to 8, and q is an integer of from 0 to 3.

More particularly, L' represents the same or different ligands that comprise at least one oxygen, nitrogen, sulfur, or phosphorous atom. Examples of such ligands include but are not limited to, pyridine, bipyridine, terpyridine, $P(phenyl)_3$, carboxylate, imine, phenol, mercaptophenol, imidazole, triazole, and dithiooxamide The preferred L' ligands are derived from terpyridine, $P(phenyl)_3$, and salicylimine compounds.

Also in the noted GOLD Structure, Y represents an appropriate counter anion having the appropriate charge. Useful anions include but are not limited to, halides (such as chloride and bromide), perchlorate, tetrafluoroborate, sulfate, sulfonate, methylsulfonate, p-toluenesulfonate, tetrafluoroantimonate, and nitrate. Halides are preferred.

The GOLD Structure also comprises r that is an integer from 1 to 8 (preferably from 1 to 3), and q is 0 or an integer from 1 to 3 (preferably, 3).

The total amount of chemical sensitizers that may be used during formulation of the emulsion will generally vary depending upon the average size of silver halide grains. The total amount is generally at least $10^{-10}$ mole per mole of total silver, and preferably from $10^{-8}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary skill in the art.

As noted above, it preferred to add spectral sensitizing dyes to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S.

Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.) are effective in the practice of the invention.

An appropriate amount of spectral sensitizing dye added is generally about $10^{-10}$ to $10^{-1}$ mole, and preferably, about $10^{-7}$ to $10^{-2}$ mole per mole of silver halide.

To further control the properties of photothermographic materials, (for example, contrast, $D_{min}$, speed, or fog), it may be preferable to add one or more heteroaromatic mercapto compounds or heteroaromatic disulfide compounds as "supersensitizers". Examples include compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. Many of the above compounds are described in EP-A-0 559 228 (Philip Jr. et al.) as supersensitizers for infrared photothermographic materials.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenz-imidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

Non-Photosensitive Reducible Silver Source Material

The non-photosensitive source of reducible silver ions used in photothermographic materials prepared by the present invention can be any material that contains reducible silver ions in catalytic association with the photosensitive silver halide. Preferably, it is a silver salt that is comparatively stable to light and forms a silver image when heated to 80° C. or higher in the presence of an exposed photosensitive silver halide and a reducing agent.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferred examples of the silver salts of aromatic carboxylic acid and other carboxylic acid group-containing compounds include, but are not limited to, silver benzoates, a silver substituted-benzoate, such as silver 3,5-dihydroxy-benzoate, silver o-methylbenzoate, silver m-methyl-benzoate, silver p-methylbenzoate, silver 2,4-dichlorobenzoate, silver acetamido-benzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates comprising hydrocarbon chains incorporating ether or thioether linkages, or sterically hindered substitution in the α-(on a hydrocarbon group) or ortho- (on an aromatic group) position, and displaying increased solubility in coating solvents and providing coatings with less light scattering can also be used. Such silver carboxylates are described in U.S. Pat. No. 5,491,059 (noted above). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-amino-thiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free carboxylic acid and analyzing for about 22% silver, can be used. For opaque photothermographic materials, different amounts can be used.

Another useful source of non-photosensitive reducible silver ions in the practice of this invention are the silver dimer compounds that comprise two different silver salts as described in copending U.S. Ser. No. 09/812,597 filed Mar. 20, 2001 by Whitcomb and entitled "Asymmetric Silver Salt Dimers and Imaging Compositions, Materials and Methods Using Same" that is based on Provisional Application No. 60/201,857 filed May 4, 2000. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

In addition, the non-photosensitive silver compounds can be prepared as mixtures of non-photosensitive silver compounds. One such mixture can be prepared by the sequential formation of a second non-photosensitive silver compound in the presence of a previously prepared non-photosensitive silver compound. Such compounds have been referred to as "core-shell" silver salts. The preparation of such compositions would be readily apparent from the teaching provided herein as well as that provided in copending and commonly assigned U.S. Ser. No. 09/761,954 filed Jan. 17, 2001 by Whitcomb and Pham.

Emulsion prepared by this invention can include mixtures of silver salts of various types as illustrated above.

The methods used for making silver soap dispersions are well known in the art and are disclosed in *Research Disclosure,* April 1983, item 22812, *Research Disclosure,* October 1983, item 23419, U.S. Pat. No. 3,985,565 (Gabrielsen et al.) and the references cited above.

Because of the way the photothermographic emulsions are made using the present invention, the photosensitive silver halide and the non-photo-sensitive source of reducible silver ions are in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layer. Stated another way, the amount of the sources of reducible silver ions is generally present in an amount of from about 0.001 to about 0.2 mol/m$^2$ of the dry photothermographic material, and preferably from about 0.01 to about 0.05 mol/m$^2$ of that material.

The total amount of silver (from all silver sources) in the photo-thermographic materials is generally at least 0.002 mol/m$^2$ and preferably from about 0.01 to about 0.05 mol/m$^2$.

Reducing Agents

For black-and-white imaging materials, the reducing agent (or reducing agent composition comprising two or more components) for the nonphotosensitive source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.), incorporated herein by reference.

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Hindered phenol reducing agents are preferred (alone or in combination with one or more co-developers and contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis (hydroxyphenyl)methanes, hindered phenols, and hindered naphthols each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5 '-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX or PERMANAX WSO), 1,1'-bis(3,5-di-t-butyl-4-hydroxyphenyl)methane, 2,2'-bis (4-hydroxy-3-methylphenyl)propane, 4,4'-ethylidene-bis(2-t-butyl-6-methylphenol), 2,2'-isobutylidene-bis(4,6-dimethylphenol) (LOWINOX 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienyl-amidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxy-benzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alanine-hydroxamic acid), a combination of azines and sulfonamidophenols (for example, phenothiazine and 2,6-dichloro4-benzenesulfonamidophenol), α-cyanophenyl-acetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)-methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfon-amidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.).

Useful co-developer reducing agents can also be used as described for example, in copending U.S. Ser. No. 09/239,182 (filed Jan. 28, 1999 by Lynch and Skoog), incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents noted above are incorporated herein by reference.

Yet another class of co-developers are substituted acrylonitrile compounds that can be represented by structure III as follows:

$$H(R')C{=}C(R)CN \qquad \text{III}$$

wherein R is a substituted or unsubstituted aryl group of 6 to 14 carbon atoms in the single or fused ring structure (such as phenyl, naphthyl, p-methylphenyl, p-chlorophenyl, 4-pyridinyl and o-nitrophenyl groups) or an electron withdrawing group (such as a halo atom, cyano group, carboxy group, ester group and phenylsulfonyl group). R' is a halo group (such as fluoro, chloro and bromo), hydroxy or metal salt thereof, a thiohydrocarbyl group, an oxyhydroxycarbyl group, or a substituted or unsubstituted 5- or 6-membered aromatic heterocyclic group having only carbon atoms and 1 to 4 nitrogen atoms in the central ring (with or without fused rings attached), and being attached through a non-quaternary ring nitrogen atom (such as pyridyl, furyl, diazolyl, triazolyl, pyrrolyl, tetrazolyl, benzotriazolyl, benzopyrrolyl and quinolinyl groups). Further details of these compounds and their preparation can be found in U.S. Pat. No. 5,635,339 (Murray) and U.S. Pat. No. 5,545,515 (Murray et al.), both incorporated herein by reference.

Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene) cyanoacetates and their metal salts.

Various contrast enhancers can be used in some photothermo-graphic materials with specific co-developers. Examples of useful contrast enhancers include, but are not limited to, hydroxylamines (including hydroxyl-amine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the above patents are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Other Addenda

The photothermographic materials prepared using the present invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

The photothermographic materials can be further protected against the production of fog and can be stabilized against loss of sensitivity during storage. It may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethyl-sulfonyl) quinoline compounds as described in U.S. Pat. No. 5,460, 938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzo-triazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), compounds having —$SO_2CBr_3$ groups as described for example in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600 589 (Philip, Jr. et al.) and EP-A-0 600 586 (Philip, Jr. et al.), and tribromomethylketones as described, for example, in EP-A-0 600 587 (Oliff et al.).

Preferably, the photothermographic materials include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermo-graphic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (Agfa-Gevaert).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+)trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], inorganic peroxides and persulfates (such as ammonium peroxydisulfate and hydrogen peroxide), benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazines and phthalazine derivatives [such as those described in U.S. Pat. No. 6,146,822 (noted above), incorporated herein by reference] are particularly useful toners.

Binders

The photosensitive silver halide, the non-photosensitive source of reducible silver ions, the reducing agent composition, and any other additives used in the present invention are generally used in one or more binders that are either hydrophilic or hydrophobic. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company).

Examples of useful hydrophilic binders include, but are not limited to, gelatin and gelatin-like derivatives (hardened or unhardened), cellulosic materials such as cellulose acetate, cellulose acetate butyrate, hydroxymethyl cellulose, acrylamide/methacrylamide polymers, acrylic/methacrylic polymers polyvinyl pyrrolidones, polyvinyl acetates, polyvinyl alcohols, and polysaccharides (such as dextrans and starch ethers).

Hardeners for various binders may be present if desired. Useful hardeners are well known and include diisocyanate compounds as described for example in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder not decompose or lose its structural integrity at 120° C. for 60 seconds. It is more preferred that it not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials can be prepared using a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure*, August 1979, item 18431. A method of making dimensionally stable polyester films is described in *Research Disclosure,* September, 1999, item 42536.

Opaque supports can also be used such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The formulation for the photothermographic emulsion layer(s) can be prepared by dissolving and dispersing the binder, the photothermographic emulsion (that is, the photosensitive silver halides and the non-photosensitive source of reducible silver ions), the reducing composition, and optional addenda in an organic solvent, such as toluene, 2-butanone (or methyl ethyl ketone), acetone or tetrahydrofuran.

Alternatively, these components can be formulated with a hydrophilic binder in water or water-organic solvent mixtures to provide aqueous-based coating formulations.

Photothermographic materials can also contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The photothermographic materials can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials can be constructed of one or more layers on a support. Single layer materials should contain the photosensitive silver halide, the non-photosensitive source of reducible silver ions, the reducing composition, the binder, as well as optional materials such as toners, acutance dyes, coating aids and other adjuvants.

Two-layer constructions comprising a single imaging layer coating containing all the ingredients and a protective topcoat are generally found in the photothermographic materials. However, two-layer constructions containing photosensitive silver halide and non-photosensitive source of reducible silver ions in an emulsion layer (usually the layer adjacent to the support) and the reducing composition and other ingredients in a different layer or distributed between both layers are also envisioned.

Layers to promote adhesion of one layer to another are also known, as described for example, in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.).

Photothermographic emulsions of this invention can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S.

Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford), all incorporated herein by reference. A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers, described above, may be used. Such formulations are described in copending and commonly assigned U.S. Ser. No. 09/510,648 filed Feb. 23, 2000 by Ludemann, LaBelle, Geisler, Warren, Crump, and Bhave) that is based on Provisional Application No. 60/121,794, filed Feb. 26, 1999.

Mottle and other surface anomalies can be reduced in the materials of this invention by incorporation of a fluorinated polymer as described for example, in U.S. Pat. No. 5,532,121 (Yonkoski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, the manufacturing method can also include forming on the opposing or backside of said polymeric support, one or more additional layers, including an antihalation layer, an antistatic layer, or a layer containing a matting agent (such as silica), or a combination of such layers. It is also contemplated that the photothermographic materials of this invention can include emulsion layers on both sides of the support.

To promote image sharpness, photothermographic materials can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials contain an antihalation coating on the support opposite to the side on which the emulsion and topcoat layers are coated.

Dyes particularly useful as antihalation and acutance dyes include dihydroperimidine squaraine dyes having the nucleus represented by the following general structure:

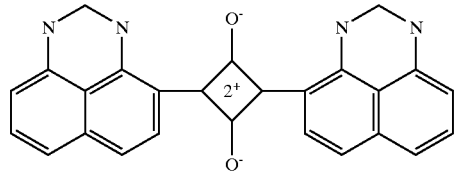

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

Dyes particularly useful as antihalation dyes in a backside layer of the photothermographic material also include indolenine cyanine dyes having the nucleus represented by the following general structure:

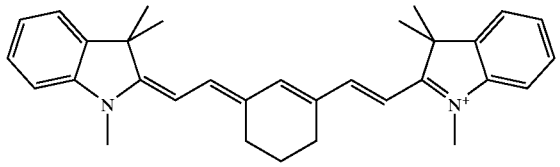

Details of such antihalation dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-meth yl-1-cyclohexen-1-yl]ethenyl]-1,3,3-trimethyl-, perchlorate.

It is also useful in the present invention to employ acutance or antihalation dyes that will decolorize with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

Imaging/Development

While the photothermographic materials can be imaged in any suitable manner consistent with the type of material using any suitable imaging source (typically some type of radiation or electronic signal), the following discussion will be directed to the preferred imaging means. Generally, the materials are sensitive to radiation in the range of from about 190 to about 850 nm.

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, September 1996, item 38957, (such as sunlight, xenon lamps and fluorescent lamps). Particularly useful exposure means uses laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For using the photothermographic materials, development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

Use as a Photomask

The photothermographic materials described herein are sufficiently transmissive in the range of from about 350 to about 450 nm in non-imaged areas to allow their use in a process where there is a subsequent exposure of an ultraviolet or short wavelength visible radiation sensitive imageable medium. For example, imaging the materials and subsequent development affords a visible image. The heat-developed photothermographic materials absorb ultraviolet or short wavelength visible radiation in the areas where there is a visible image and transmits ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

Methods and Materials for the Examples:

All materials used in the following examples are readily available from standard commercial sources, such as Aldrich Chemical Co. (Milwaukee Wis.) unless otherwise specified. All percentages are by weight unless otherwise indicated.

ACRYLOID™ A-21 or PARALOID A-21 is an acrylic copolymer available from Rohm and Haas (Philadelphia, Pa.).

BLTVAR® B-79 is a polyvinyl butyral resin available from Solutia, Inc. (St. Louis, Mo.).

CAB 171-15S is a cellulose acetate butyrate resin available from Eastman Chemical Co (Kingsport, Tenn.).

CBBA is p-(4-chlorobenzoyl)benzoic acid DESMODUR N3300 is an aliphatic hexamethylene diisocyanate available from Bayer Chemicals (Pittsburgh, Pa.).

PERMANAX WSO (or NONOX) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

MEK is methyl ethyl ketone (or 2-butanone).

Chemical Sensitizers:

CS-A

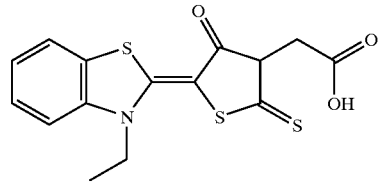

$(C_2H_5)_3N$

CS-B

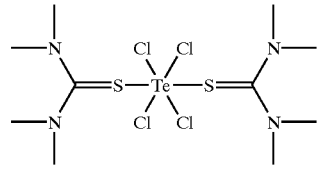

CS-C

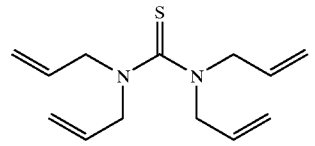

Compound CS-D is Au(III)(terpyridine)$Cl_3$. It is described in L. Hollis et al., *J. Am. Chem. Soc.,* 1983,105, 4293 and in U.S. Ser. No. 09/768,094 (noted above).

Spectral Sensitizing Dyes:

Green Spectral Sensitizing Dye-A is:

SSD-A

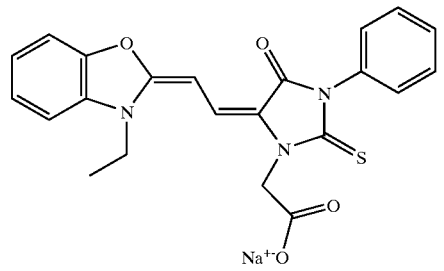

Red Spectral Sensitizing Dye -B is

SSD-B

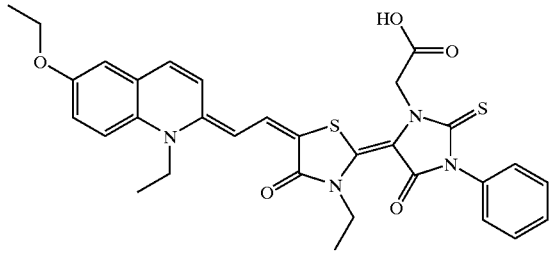

Infrared Spectral Sensitizing Dye-C is

SSD-C

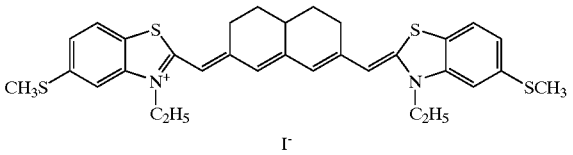

High contrast Compound HC-1 is described in U.S. Pat. No. 5,545,515 (noted above) and has the following structure:

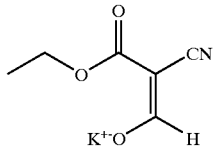

Vinyl Sulfone-1 (VS-1) is described in EP-0 600 589B1 and has the following structure:

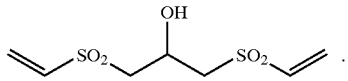

Antifoggant A is 2-(tribromomethylsulfonyl)quinoline and has the following structure:

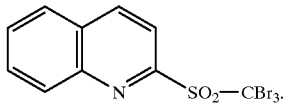

Antifoggant B is:

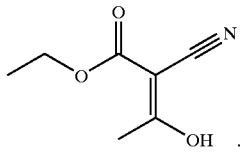

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

BC-1

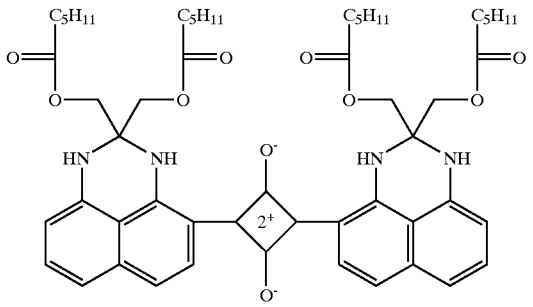

Densitometry measurements were made on a custom built computer-scanned densitometer using a filter appropriate to the sensitivity of the photothermographic material and are believed to be comparable to measurements from commercially available densitometers. $D_{min}$ is the density of the non-exposed areas after development and it is the average of the eight lowest density values. Speed-1 ("SP-1") is log 1/E+4 corresponding to the density value of 0.2 above $D_{min}$ where E is the exposure in ergs/cm$^2$. Speed-2 ("SP-2") is Log 1/E+4 corresponding to the density value of 1.00 above $D_{min}$ where E is the exposure in ergs/cm$^2$. Speed-3 ("SP-3") is Log 1/E+4 corresponding to the density value of 2.90 above $D_{min}$ where E is the exposure in ergs/cm$^2$. Average Contrast-1 ("AC-1") is the absolute value of the slope of the line joining the density points at 0.60 and 2.00 above $D_{min}$. Contrast-D ("Con-D") is the absolute value of the slope of the line joining the density points at 1.00 and 3.00 above $D_{min}$.

The following examples are representative of the present invention and its practice, and are not meant to be limiting in any manner.

EXAMPLES 1–4

The following examples compare the use of photothermographic materials prepared from emulsion in which PMT was present during the preparation of the silver halide grains with similar photothermographic materials prepared described in U.S. Pat. No. 5,434,043 (noted above) but not incorporating such silver halide grains. This similar material is referred to as Control A.

The silver halide grains in emulsions used in the following examples, when chemically sensitized, were chemically sensitized according to procedures described in U.S. Pat. No. 5,891,615 (noted above), U.S. Ser. No. 09/667,748 (noted above), U.S. Ser. No. 09/746,400 (noted above), or U.S. Ser. No. 09/768,094 (noted above). In addition, the emulsions were then spectrally sensitized to the wavelength of interest and further prepared for coating.

EXAMPLE 1

Preparation of Photothermographic Emulsions

Preparation of Silver Halide Emulsion by Procedure A

This procedure describes the preparation of an iridium-doped core-shell silver iodobromide emulsion in the presence of 1-phenyl-5-mercapto tetrazole (PMT, Compound Y-1).

A reaction vessel equipped with a stirrer was charged with 28 g of phthalated gelatin, 468 ml of water, 0.71 g of silver nitrate (for initial pAg adjustment), an antifoaming agent, and sufficient 2N nitric acid to adjust the pH to 5.0.

The temperature of the solution was raised to 36° C. Solutions A and B were simultaneously double-jetted into the reaction vessel using an initial flow rate of 16 ml/min. Both pAg and the temperature of the reactor were held constant during the addition. The pAg was held constant by means of a pAg feedback control loop as described in Research Disclosure, item 17643, U.S. Pat. No. 3,415,650 (Frame et al.), U.S. Pat. No. 3,782,954 (Porter et al.), and U.S. Pat. No. 3,821,002 (Culhane et al.). The flow rates of reactant introductions were accelerated as the function of total reaction time, t (min) using the following equation:

$$\text{Flow Rate}=16(1+0.004t^2)\ \text{ml/min.}$$

After about 145 g of Solution B had been added, Solution A was replaced with Solution C, and silver halide growth was continued until all of Solution B was consumed. The emulsion was acidified, the resulting coagulum washed with deionized water, and pH was adjusted to 5.5. Scanning Electron Microscopy (SEM) determined the average grain size was 0.075 $\mu$m.

The materials for the preparation of 1 mole of silver halide emulsion by Procedure A are shown below.

Solution A was prepared at 25° C. as follows:

| | |
|---|---|
| potassium bromide | 55.2 g |
| potassium iodide | 6.7 g |
| deionized water | 205 g. |

Solution B was prepared at 25° C. as follows:

| | |
|---|---|
| silver nitrate | 170 g |
| deionized water | 409 g. |

Solution C was prepared at 50° C. as follows:

| | |
|---|---|
| potassium bromide | 133.3 g |
| PMT | 0.28 g |
| deionized water | 436 g. |

After dissolving the PMT at 50° C, the solution was allowed to cool to 25° C. and a solution of $K_2IrCl_6$ (11.2 mg) in 40 g of deionized water was added to form Solution C.

Preparation of Photosensitive Silver Soap Dispersion

A photosensitive silver soap dispersion was prepared as described below. This composition is also sometimes known as a "silver soap emulsion.", "preformed soap", or "homogenate".

I. Ingredients:

1. Silver halide emulsion (0.10 mole) at 700 g/mole in 1.25 liters of water at 42° C.
2. 88.5 g of sodium hydroxide in 1.50 liter of water.
3. 360 g of silver nitrate in 2.5 liters of water.
4. 118 g of Humko Type 9718 fatty acid (available from Witco. Co., Memphis, Tenn.).
5. 570 g of Humko Type 9022 fatty acid (available from Witco. Co., Memphis, Tenn.).
6. 19 ml of concentrated nitric acid in 50 ml of water.

II. Reaction:

1. Ingredients #4 and #5 were dissolved at 80° C. in 12 liters of water and mixed for 15 minutes.
2. Ingredient #2 was added to the Step 1 solution at 80° C. and mixed for 5 minutes to form a dispersion.
3. Ingredient #6 was added to the dispersion at 80° C., while cooling the dispersion to 55° C. and stirring for 25 minutes.
4. Ingredient #1 was added to the dispersion at 55° C. and mixed for 5 minutes.
5. Ingredient #3 was added to the dispersion at 55° C. and mixed for 10 minutes.
6. The dispersion was washed until the wash water had a resistivity of 20,000 ohm/cm$^2$.
7. The dispersion was dried at 45° C. for 72 hours.

III. Homogenization

A photosensitive silver soap dispersion was prepared by homogenizing the pre-formed soaps prepared above in organic solvent and BUTVAR® B-79 poly(vinyl butyral) according to the following procedure 1. 440 g of pre-formed soap were added to 1530 g of 2-butanone and 30 g of BUTVAR® B-79.
2. The dispersion was mixed for 5 minutes and held for 4 hours at room temperature.
3. The dispersion was homogenized twice at 5000 psi.

Preparation of Photothermographic Emulsions

Photothermographic emulsions were prepared from the photosensitive silver soap dispersions prepared above as follows:

To 209 g of a photosensitive silver soap dispersion containing 46 g of silver halide/silver carboxylate dispersion described above were added:

| | |
|---|---|
| MEK | 8 g |
| Pyridinium hydrobromide perbromide | 0.2544 g |
| Zinc bromide | 0.288 g |
| Chemical sensitizer solution (see below for formulations) | |
| Spectral sensitizer solution (see below for formulations) | |
| BUTVAR ® B-79 polyvinyl butyral | 31.8 g |
| Antifoggant A | 1.6 g |
| DESMODUR N3300 | 0.49 g |
| Phthalazine | 1.2 g |
| Tetrachlorophthalic acid | 0.27 g |
| 4-Methylphthalic acid | 0.60 g |
| PERMANAX WSO | 12.0 g |
| HC-1 high contrast agent | 0.215 g |

Chemical sensitizers

| | |
|---|---|
| CS-A-1 | 0.018 g dissolved in 2.25 g of methanol and 2.25 g of MEK |
| CS-A-2 | 0.036 g dissolved in 4.50 g of methanol and 4.50 g of MEK |
| CS-A-3 | 0.042 g dissolved in 5.25 g of methanol and 5.25 g of MEK |
| CS-B | 0.0139 g dissolved in 3.5 g of methanol. |
| CS-C | 0.024 g dissolved in 6 g of methanol |

Spectral Sensitizing Dye solution for Red Sensitization:

| | |
|---|---|
| SSD-B | 0.01427 g (0.02368 mmol) |
| Chlorobenzoyl benzoic acid | 2.32 g |
| 2-Mercaptobenzoxazole | 0.0071 g (0.0926 mmol) |
| Methanol | 9.82 g |

Spectral Sensitizing Dye solution for IR Sensitization:

| | |
|---|---|
| SSD-C | 0.00792 g (0.0113 mmol) |
| Chlorobenzoyl benzoic acid | 2.32 g |
| 2-Mercaptobenzoxazole | 0.0071 g (0.0926 mmol) |
| Methyl mercapto benzimidazole | 0.108 g |
| Methanol | 2.448 g |
| MEK | 7.338 g |

Protective topcoat Formulation:

A protective topcoat for the photothermographic formulation layer was prepared as follows:

| | |
|---|---|
| ACRYLOID A-21 or PARALOID A-21 | 0.052 g |
| CAB 171-15S | 1.34 g |
| MEK | 16.95 g |
| VS-1 | 0.079 g |

Photothermographic emulsions and other coating formulations were coated out under appropriate safelights using a conventional dual-knife coater. The photothermographic emulsions and topcoat formulations were coated onto a 4 mil (102 am) polyethylene terephthalate support provided with a conventional backside antihalation coating comprising a dye that has absorbance >1.0 at the wavelength of exposure (670 nm for the red sensitized emulsion and 780 nm for the IR sensitized emulsion). The coated layers were then dried for about 4 minutes at 85° C.

In addition to the red-sensitized photothermographic emulsion employing SSD-B and the infrared-sensitized photothermographic emulsion employing SSD-C, a control emulsion, Control A, was prepared in an identical manner but omitting PMT during formation of the silver halide grains.

Both materials were coated, dried, imaged, and developed as described above. The resulting photothermographic materials were imagewise exposed using a scanning laser sensitometer having a 670 nm laser diode for the red sensitized materials and a 780 nm laser diode for the IR sensitized materials. The materials were then developed using a heated roller processor for 13 seconds at 118° C., unless noted otherwise The sensitometric data, shown below in TABLE I, demonstrate that photothermographic materials prepared using silver halide grains formed in the presence of PMT have lower $D_{min}$, similar speed and significantly higher contrast (Con-D) than similar photothermographic materials not so prepared.

TABLE I

| Emulsion | Chemical Sensitizer | Spectral Sensitizer | $D_{min}$ | SP-3 | Con-D | Total Silver g/m$^2$ |
|---|---|---|---|---|---|---|
| Invention | CS-B | SSD-B | 0.08 | 2.7 | 33.4 | 1.82 |
| Control A | CS-B | SSD-B | 0.09 | 2.8 | 18.5 | 1.85 |
| Invention | CS-A-2 | SSD-C | 0.115 | 2.6 | 33.1 | 1.85 |
| Control A | CS-A-1 | SSD-C | 0.139 | 2.7 | 18.9 | 1.85 |

COMPARATIVE EXAMPLE 1

This example demonstrates that incorporation of PMT into the photothermographic material by other methods does not provide advantages comparable to those obtained by preparing the silver halide grains in the presence of PMT.

Two samples of a photothermographic material were prepared using the Control A emulsion. CS-C (described in Example 1) was used as the chemical sensitizer compound and SSD-B was used to spectrally sensitize the materials to the red region of spectrum. The first sample had a topcoat prepared as described in Example 1. The second sample had a topcoat similarly prepared but incorporating 0.016 g of 1-phenyl-5-mercaptotetrazole (PMT) per 18 g of topcoat.

The samples were coated, dried, imaged, and developed in an identical manner. The sensitometric data, shown below in TABLE II, demonstrate that adding PMT to the topcoat does not provide the same $D_{min}$ suppression and contrast enhancement as are provided by materials of the present invention. It should also be noted addition of PMT to the topcoat resulted in an increase in $D_{min}$ as well as a decrease in contrast (Con-D).

TABLE II

| Emulsion | $D_{min}$ | SP-3 | Con D | Total Silver g/m$^2$ |
|---|---|---|---|---|
| Control with PMT in Topcoat | 0.15 | 3.3 | 20 | 1.84 |
| Control A | 0.12 | 3.2 | 25.2 | 1.87 |

EXAMPLE 2

Photothermographic emulsions of the present invention were compared to similarly prepared emulsions in which PMT was added to the homogenate after formation of the silver halide grains and prior to chemical sensitization. All of the silver halide grains were chemically sensitized using CS-B and were red-sensitized using SSD-B.

The resulting spectrophotometric data, presented below in TABLE III demonstrate that adding PMT at later steps in the preparation of the photothermographic emulsion does not provide the same $D_{min}$ suppression and contrast enhancement as are provided when PMT is present during formation of the silver halide grains.

TABLE III

| Emulsion | Dmin | SP-3 | Con-D | Total Silver g/m$^2$ |
|---|---|---|---|---|
| Invention | 0.09 | 2.69 | 37.5 | 1.97 |
| Control A | 0.11 | 2.81 | 18.8 | 1.99 |
| Control A with 0.16 g PMT added | No Image | — | — | — |
| Control A with 0.016 g PMT added | 0.14 | 2.14 | 30.2 | 1.87 |
| Control A with 0.0016 g PMT added | 0.11 | 2.76 | 22.8 | 1.87 |

EXAMPLE 3

The following example demonstrates that photothermographic materials prepared from photothermographic emulsions in which PMT was present during the formation of the silver halide grains have improved stability upon storage of the unimaged materials.

Red-sensitive photothermographic materials were prepared and evaluated as described in Example 3. Again, all of the silver halide grains were chemically sensitized using CS-B and were red-sensitized using SSD-B. The photothermographic materials were evaluated after coating and again after they had been stored for 5 months at 21° C. Materials in this example were developed by heating for 18 seconds at 118° C.

The resulting spectrophotometric data, shown below in TABLE IV indicate that there is a significant difference in $D_{min}$ increase ($\Delta D_{min}$) in photothermographic materials outside of the present invention, but that the present invention greatly reduces that increase upon extended keeping.

TABLE IV

| Emulsion | $\Delta$ $D_{min}$ (after 5 months of shelf keeping - initial) |
|---|---|
| Invention | +0.018 |
| Control A | +0.306 |
| Control A with 0.016 g PMT added to homogenate | +1.764 |
| Control A with 0.0016 g PMT added to homogenate | +1.425 |

EXAMPLE 4

An infrared-sensitive photothermographic material was prepared as described in Example 1. Two levels of PMT were used during silver halide grain growth. The silver halide grains were chemically sensitized using 0.042 g of CS-A and were infrared-sensitized using SSD-C. All photothermographic materials were prepared, coated, dried, and imaged as described in Example 1.

The spectrophotometric data, shown below in TABLE V, indicate both samples gave similar sensitometric results indicating that a level of PMT of 0.15 g PMT/mole of silver halide is only slightly less effective than a level of 0.25 g PMT/mole of silver halide.

TABLE V

| Emulsion | Amount of PMT g/mol AgX | $D_{min}$ | SP-3 | Con-D | Total Silver g/m$^2$ |
|---|---|---|---|---|---|
| Invention | 0.15 | 0.248 | 2.88 | 13.8 | 1.89 |
| Invention | 0.25 | 0.233 | 2.92 | 15.3 | 1.89 |

EXAMPLES 5–8

The following examples compare the use of photothermographic materials prepared from emulsion in which PMT was present during the preparation of the silver halide grains with similar photothermographic materials prepared described in U.S. Pat. No. 5,382,504 (noted above) but not incorporating PMT during the preparation of the silver halide grains. This similar material is referred to as Control B.

The photothermographic emulsions were chemically sensitized according to procedures described in U.S. Pat. No. 5,891,615 (noted above), or U.S. Ser. No. 09/768,094 (noted above). In addition, some emulsions were prepared and evaluated without being spectrally sensitized. Others were spectrally sensitized to the wavelength of interest.

EXAMPLE 5

Preparation of Photothermographic Emulsions

Preparation of Silver Halide Emulsion by Procedure B

This procedure describes the preparation of 4.3 moles of a silver bromoiodide emulsion with a uniform distribution of iodide in the presence of 1-phenyl-5-mercaptotetrazole (PMT, Compound Y-1)

A reaction vessel equipped with a stirrer was charged with 75 g of phthalated gelatin, 1650 g of deionized water, 40 ml of a 0.2 molar potassium bromide solution, an antifoamant, and sufficient 2N nitric acid to adjust the pH to 5.0.

The temperature of the solution was raised to 44° C. and solutions A and B were simultaneously added to the reaction vessel. Both pAg and the temperature of the reactor were held constant during the addition. The addition rates of Solutions A and B were started at 8 ml/min, then accelerated as a function of total reaction time according to the equation:

$$\text{Flow Rate}=8(1+0.005t^2)\ \text{ml/min.}$$

The reaction was terminated when all of Solution A had been consumed. The emulsion was acidified, the resulting coagulum was washed with deionized water, and the pH and adjusted to a pH of 5.5. Scanning Electron Microscopy (SEM) determined the average grain size was 0.12 $\mu$m.

Solution A was prepared at 25° C. as follows:

| | |
|---|---|
| silver nitrate | 743 g |
| deionized water | 1794 g. |

Solution B was prepared at 50° C. as follows, then allowed to cool to 25° C. before being used:

| | |
|---|---|
| potassium bromide | 559 g |
| potassium iodide | 50 g |
| PMT | 1.25 g |
| deionized water | 1900 g. |

Preparation of Photosensitive Silver Soap Dispersion

A photosensitive silver soap dispersion was prepared as described below. This composition is also sometimes known as a "silver soap emulsion.", "preformed soap", or "homogenate".

I. Ingredients:

1. Silver halide emulsion (0.20 mole) at 700 g/mole in 1.25 liters of water at 42° C.
2. 88.5 g of sodium hydroxide in 1.50 liter of water.
3. 360 g of silver nitrate in 2.5 liters of water.
4. 118 g of Humko Type 9718 fatty acid (available from Witco. Co., Memphis, Tenn.).
5. 570 g of Humko Type 9022 fatty acid (available from Witco. Co., Memphis, Tenn.).
6. 19 ml of concentrated nitric acid in 50 ml of water.

II. Reaction:

1. Ingredients #4 and #5 were dissolved at 80° C. in 12 liters of water and mixed for 15 minutes.
2. Ingredient #2 was added to the Step 1 solution at 80° C. and mixed for 5 minutes to form a dispersion.
3. Ingredient #6 was added to the dispersion at 80° C., while cooling the dispersion to 55° C. and stirring for 25 minutes.
4. Ingredient #1 was added to the dispersion at 55° C. and mixed for 5 minutes.
5. Ingredient #3 was added to the dispersion at 55° C. and mixed for 10 minutes.
6. The dispersion was washed until the wash water had a resistivity of 20,000 ohm/cm$^2$.
7. The dispersion was dried at 45° C. for 72 hours.

III. Homogenization

A photothermographic emulsion was prepared by homogenizing the pre-formed soaps prepared above in organic solvent and BUTVAR® B-79 poly(vinyl butyral) according to the following procedure 1. 440 g of pre-formed soap were added to 1530 g of 2-butanone and 30 g of BUTVAR®B-79.
2. The dispersion was mixed for 5 minutes and held for 4 hours at room temperature.
3. The dispersion was homogenized twice at 5000 psi.

Preparation of Photothermographic Emulsions

Photothermographic emulsions were prepared from the photosensitive silver soap dispersions prepared above as follows:

To 199.3 g of the photosensitive silver soap dispersion containing 42.8 g of preformed silver halide/silver carboxylate soap were added:

| | |
|---|---|
| CS-A | $4.41 \times 10^{-5}$ moles |
| Pyridinium hydrobromide perbromide | 0.2 |
| Calcium bromide | 0.15 |
| CS-D | $2.2 \times 10^{-7}$ mol |
| CBBA | 1.42 g |
| BUTVAR ® B-79 | 20.0 g |
| Antifoggant A | 0.6 g |

-continued

| | |
|---|---|
| PERMANAX WSO | 10.6 g |
| DESMODUR N3300 | 0.63 g |
| Tetrachlorophthalic acid | 0.35 g |
| Phthalazine | 1.0 g |
| 4-Methylphthalic acid | 0.45 g |
| Protective topcoat Formulation: | |
| A protective topcoat for the photothermographic formulation layer was prepared as follows: | |
| ACRYLOID ™ A-21 polymer | 0.92 g |
| CAB 171-15S | 23.9 g |
| MEK | 293.8 g |
| Benzotriazole | 1.28 g |
| Antifoggant B | 0.19 g |
| VS-1 | 0.24 g |

The photothermographic emulsions and topcoat formulations were coated under safelight conditions using a dual knife coater onto a 7 mil (178 μm) blue-tinted polyethylene terephthalate support provided with a backside antihalation layer comprising dye BC-1 in CAB 171-15S resin binder. Samples were dried for 5 minutes at 82° C. unless otherwise specified. Photothermographic materials were imagewise exposed for 10–3 seconds using an EG & G Flash sensitometer with a both a P-16 and a neutral density filter attached. Samples were developed on a heated roller processor for 15 seconds at 124° C.

The sensitometric data, shown below in TABLE VI, demonstrate that photothermographic materials prepared using silver halide grains formed in the presence of PMT have lower $D_{min}$, similar speed and significantly higher contrast (Con-D) than photothermographic materials similarly prepared but not using silver halide grains formed in the presence of PMT.

TABLE VI

| Emulsion | $D_{min}$ | SP-2 | AC-1 | SP-1 |
|---|---|---|---|---|
| Invention | 0.334 | 4.064 | 2.658 | 4.434 |
| Control B | 0.355 | 4.081 | 2.361 | 4.377 |

EXAMPLE 6

In this Example, the amount of chemical sensitizing compound CS-D was varied from $2.2\times10^{-7}$ to $6.6\times10^{-7}$ moles in the emulsion incorporating PMT prepared in Example 5. Several 20 g batches of topcoat solutions were prepared with and without 0.005 g of high contrast agent HC-1.

The data, shown in TABLE VII below, demonstrate that an increase in the amount of chemical sensitizer, with or without a high contrast agent increased speed with minimal increase in $D_{min}$ using the photothermographic emulsion prepared by the present invention.

TABLE VII

| Amount of Chemical Sensitizing Compound | HC-1 Present | $D_{min}$ | SP-2 | AC-1 | SP-1 |
|---|---|---|---|---|---|
| $2.2 \times 10^{-7}$ | No | 0.291 | 4.064 | 2.665 | 4.432 |
| $4.4 \times 10^{-7}$ | No | 0.336 | 4.326 | 3.27 | 4.661 |
| $6.6 \times 10^{-7}$ | No | 0.336 | 4.32 | 3.064 | 4.637 |
| $2.2 \times 10^{-7}$ | Yes | 0.252 | 4.357 | 14.29 | 4.46 |

TABLE VII-continued

| Amount of Chemical Sensitizing Compound | HC-1 Present | $D_{min}$ | SP-2 | AC-1 | SP-1 |
|---|---|---|---|---|---|
| $4.4 \times 10^{-7}$ | Yes | 0.300 | 4.753 | 11.64 | 4.873 |
| $6.6 \times 10^{-7}$ | Yes | 0.328 | 4.832 | 10.05 | 4.964 |

EXAMPLE 7

Green-sensitive photothermographic emulsions and materials were prepared in a manner similar to those described in Example 6 except that the silver halide grains were chemically sensitized using CS-A according to the procedure described in U.S. Pat. No. 5,891,615 (noted above). Additionally, samples were spectrally sensitized using SSD-A.

Preparation of Photothermographic Emulsion

To 190.2 g of a photosensitive silver soap dispersion containing 43.3 g of preformed silver halide/silver carboxylate were added in order:

| | |
|---|---|
| CS-A | $4.41 \times 10^{-5}$ mole |
| PHP | 0.2 |
| Calcium bromide | 0.15 |
| Spectral Sensitizing Dye Solution | see below |
| BUTVAR ® B-79 | 20.0 g |
| Antifoggant A | 0.6 g |
| PERMANAX WSO | 10.6 g |
| DESMODUR N3300 | 0.63 g |
| Tetrachlorophthalic acid | 0.35 g |
| Phthalazine | 1.0 g |
| 4-Methylphthalic acid | 0.45 g |
| Spectral Sensitizing Dye solution for Green Sensitization: | |
| SSD-A | $4.75 \times 10^{-5}$ mol |
| CBBA | 1.42 g |
| Methanol | 5.0 g |
| Protective topcoat Formulation: | |
| A protective topcoat for the photothermographic emulsion layer was prepared as follows: | |
| ACRYLOID A-21 | 0.92 g |
| CAB 171-15S | 23.9 g |
| MEK | 293.8 g |
| Benzotriazole | 2.56 g |
| Antifoggant B | 0.19 g |
| VS-1 | 0.48 g |

This material was compared with a similar photothermographic material prepared as described in U.S. Pat. No. 5,382,504 (noted above) but not incorporating PMT during the formation of the silver halide grains. This material is referred to as Control B.

Samples were coated and dried as described above. The resulting photothermographic materials were imagewise exposed for 10–3 seconds using an EG & G Flash sensitometer with both a P-31 light filter and a neutral density filter attached. Samples were developed on a heated roller processor for 15 seconds at 124° C.

The results, shown in TABLE VIII below, demonstrate that green spectrally sensitized photothermographic emulsion of the present invention provide lower $D_{min}$ and higher contrast than similarly prepared materials not employing silver halide grains formed in the presence of PMT.

TABLE VIII

| Emulsion | $D_{min}$ | SP-2 | AC-1 | SP-1 |
|---|---|---|---|---|
| Invention | 0.271 | 3.007 | 3.946 | 3.275 |
| Control B | 0.326 | 3.240 | 2.023 | 3.688 |

EXAMPLE 8

Photothermographic materials similar to those described in Example 7 were prepared but 0.005 g of high contrast agent HC-1 was added to 20 g of the topcoat formulation.

The data, shown below in TABLE IX, demonstrate that green spectrally sensitized emulsions of the present invention provide lower $D_{min}$ and higher contrast than the emulsions outside of the present invention.

TABLE IX

| Emulsion | $D_{min}$ | SP-2 | AC-1 | SP-1 |
|---|---|---|---|---|
| Invention | 0.271 | 3.237 | 19.16 | 3.323 |
| Control B | 0.305 | 3.466 | 15.393 | 3.608 |

EXAMPLE 9

Photothermographic emulsions and materials were prepared using Procedure B. In this example, the silver halide grains had an average grain size of 0. 12 $\mu$m but grown in the presence of 0.5 g of 4-hydroxy-6-methyl-1,3,3a,7-tetrazaindene (compound X-1) instead of PMT. The tetrazaindine was present at a ratio of 0.12 g/mol of silver halide.

A control photothermographic material was also prepared. It incorporated the Control B emulsion prepared as described in Example 7.

The resulting photothermographic materials were coated, dried, imaged, and heat-developed as described in Examples 7.

The sensitometric results, shown in TABLE X below, demonstrate that $D_{min}$ can be lowered and contrast increased by growing the silver halide grains in the presence of a tetrazaindene compound.

TABLE X

| Emulsion | Amount Compound X-1 g/mol AgX | $D_{min}$ | SP-2 | AC-1 |
|---|---|---|---|---|
| Invention | 0.13 | 0.242 | 2.766 | 3.887 |
| Control B | 0 | 0.282 | 2.887 | 2.692 |

The invention has been described in detail with particular reference to certain preferred embodiments thereof, but it will be understood that variations and modifications can be effected within the spirit and scope of the invention.

We claim:

1. A method for making a photothermographic emulsion comprising the steps of:

A) providing photosensitive silver halide grains that have been formed in the presence of a hydroxytetrazaindene or an N-heterocyclic compound comprising at least one mercapto group, and B) providing a photosensitive dispersion of said photosensitive silver halide grains with a non-photosensitive source of reducible silver ions.

2. The method of claim 1 wherein said photosensitive silver halide grains are silver chloride, silver bromide, silver iodide, silver iodobromide, or silver chlorobromide grains, or a mixture of any of these grains.

3. The method of claim 1 wherein said photosensitive silver halide grains have been formed in the presence of a hydroxytetrazaindene represented by one of the following Structures INDENE-1, INDENE-2, INDENE-3, INDENE-4, INDENE-5, INDENE-6, or INDENE-7:

INDENE-1

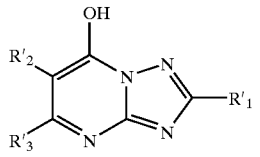

INDENE-2

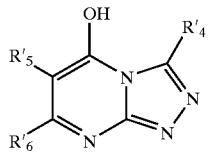

INDENE-3

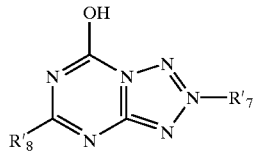

INDENE-4

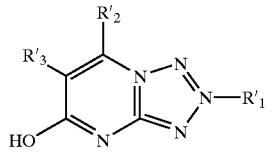

INDENE-5

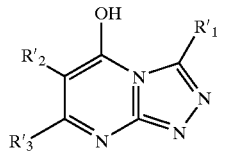

INDENE-6

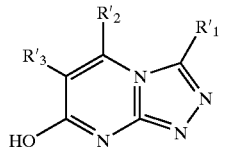

INDENE-7

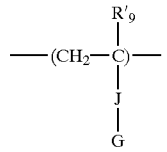

wherein $R'_1$ to $R'_9$ are independently hydrogen, an aliphatic group, or an aryl group, G represents a monovalent group formed by eliminating one hydrogen atom from the compounds represented by the formulae INDENE-1, INDENE-2, INDENE-3, INDENE-4, INDENE-5, and INDENE-6, and J represents a divalent linking group.

4. The method of claim 4 wherein said hydroxytetraazaindene compound is:

X-1 4-hydroxy-6-methyl-1,3,3a,7-tetrazaindene,

X-2 4-hydroxy-6-phenyl-1,3,3a,7-tetrazaindene,

X-3 4-methyl-6-hydroxy-1,3,3a,7-tetrazaindene,

X-4 2,6-dimethyl-4-hydroxy-1,3,3a,7-tetrazaindene,

X-5 4-hydroxy-5-ethyl-6-methyl-1,3,3a,7-tetrazaindene,

X-6 2,6-dimethyl-4-hydroxy-5-ethyl-1,3,3a,7-tetrazaindene,

X-7 4-hydroxy-5,6-dimethyl-1,3,3a,7-tetrazaindene,

X-8 4-hydroxy-6-methyl-1,2,3a,7-tetrazaindene,

X-9 4-hydroxy-6-phenyl-1,2,3a,7-tetrazaindene,

X-10 4-hydroxy-1,2,3a,7-tetrazaindene, and

X-11 4-methyl-6-hydroxy-1,2,3a,7-tetrazaindene.

5. The method of claim 1 wherein said photosensitive silver halide grains have been formed in the presence of a mercapto-substituted N-heterocyclic compound having the Structure HETERO:

HETERO

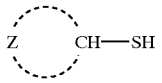

wherein Z represents at least one nitrogen atom and other atoms necessary to form a 5- to 7-membered ring.

6. The method of claim 5 wherein said mercapto-substituted N-heterocyclic compound is:

Y-1 1-phenyl-5-mercaptotetrazole (PMT),

Y-2 1-ethyl-5-mercapto-tetrazole,

Y-3 1-ethyl-5-mercapto-tetrazole,

Y-4 3-phenyl-5-mercapto-1,2,4-triazole,

Y-5 3-mercapto-5-acetylamido-1,2,4-triazole,

Y-6 3-mercapto-4-methyl-5-acetylamino-1,2,4-triazole,

Y-7 4-amino-5-mercapto-1,2,4-triazole,

Y-8 2-mercapto-5-amino-1,3,4-thiadiazole,

Y-9 1-hydroxy-2-mercapto-4-methylpyrimidine,

Y-10 2-mercapto-1,3,4-thiadiazole, or

Y-11 1-benzoylamino-2-mercapto-5-phenyl-1,3,4-triazole.

7. The method of claim 1 wherein said photosensitive silver halide grains have been formed in the presence of 1-phenyl-5-mercaptotetrazole.

8. The method of claim 1 wherein the amount of hydroxytetrazaindene or mercapto-substituted N-heterocyclic compound used in the formation of said photosensitive silver halide grains is at least $10^{-5}$ mol/mol of silver halide.

9. The method of claim 1 wherein said non-photosensitive source of reducible silver ions comprises one or more silver carboxylates.

10. The method of claim 1 further comprising adding one or more spectral sensitizing dyes to said photosensitive dispersion.

11. A method for making a photothermographic emulsion comprising the steps of:

A) providing photosensitive silver halide grains that have been formed in the presence of a hydroxytetrazaindene or an N-heterocyclic compound comprising at least one mercapto group, B) providing a photosensitive dispersion of said photosensitive silver halide grains with a non-photosensitive source of reducible silver ions, and C) after step A, chemically sensitizing said photosensitive silver halide grains with at least one sulfur-containing, tellurium-containing, or gold-containing chemical sensitizing compound, or a mixture thereof.

12. The method of claim 11 wherein said photosensitive silver halide grains are chemically sensitized prior to step B.

13. The method of claim 11 wherein photosensitive silver halide grains are chemically sensitized after step B.

14. The method of claim 11 wherein said photosensitive silver halide grains are chemically sensitized with a sulfur-containing chemical sensitizing compound that is represented by the following Structure IV, V, or VI:

IV

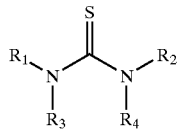

V

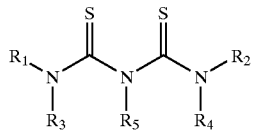

VI

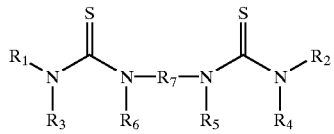

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

15. The method of claim 14 wherein said photosensitive silver halide is chemically sensitized with a sulfur-containing chemical sensitizing compound that is a 1,1,3,3-tetrasubstituted thiourea having an acid group with an acid dissociation constant (pKa) of less than 7.

16. The method of claim 11 wherein said photosensitive silver halide is chemically sensitized by decomposition of a sulfur-containing compound on or around the grains thereof in an oxidizing environment.

17. The method of claim 16 wherein said photosensitive silver halide is chemically sensitized with a sulfur-containing compound containing a thiohydantoin, rhodanine, or 2-thio-4-oxo-oxazolidine nucleus that is represented by the following Structure VII, VIII, or IX:

VII

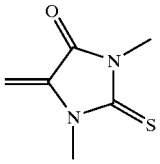

VIII

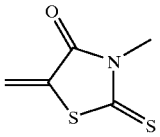

IX

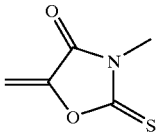

18. The method of claim 11 wherein said photosensitive silver halide grains are chemically sensitized with a tellurium-containing chemical sensitizing compound that is represented by the following Structure I, II, or III:

I

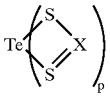

II $Te(L)_m(X^1)_n$

III $Pd(X^2)_2[Te(R')_2]_2$ wherein X represents a COR, CSR, $CN(R)_2$, CR, $P(R)_2$, or $P(OR)_2$ group, R is an alkyl, alkenyl, or aryl group, L is a ligand derived from a neutral Lewis base, $X^1$ and $X^2$ independently represent a halo, OCN, SCN, $S_2CN(R)_2$, $S_2COR$, $S_2CSR$, $S_2P(OR)_2$, $S_2P(R)_2$, SeCN, TeCN, CN, SR, OR, $N_3$, alkyl, aryl, or $O_2CR$ group, R' is an alkyl or aryl group, p is 2 or 4, m is 0, 1, 2, or 4, and n is 2 or 4, provided that when m is 0 or 2, n is 2 or 4, and when m is 1 or 4, n is 2.

19. The method of claim 11 wherein said photosensitive silver halide grains are chemically sensitized with a gold-containing chemical sensitizing compound.

20. The method of claim 19 wherein said photosensitive silver halide grains are chemical sensitized with said gold-containing chemical sensitizing compound in combination with either or both of a sulfur- or tellurium-containing chemical sensitizing compound, and the molar ratiothe molar ratio of said sulfur- or tellurium-containing chemical sensitizing compound to said gold(III)-containing chemical sensitizing compound is from about 10,000:1 to 1:10.

21. The method of claim 19 wherein said gold-containing chemical sensitizing compound is a gold(III)-containing chemical sensitizing compound that is represented by the following Structure GOLD:

$Au(III)L'_rY_q$

GOLD wherein L' represents the same or different ligands, each ligand comprising at least one heteroatom that is capable of forming a bond with gold, Y is an anion, r is an integer of from 1 to 8, and q is an integer of from 0 to 3.

22. The method of claim 21 wherein L' is pyridine, bipyridine, terpyridine, $P(phenyl)_3$, carboxylate, imine, phenol, mercaptophenol, imidazole, triazole, and dithiooxamide, Y is a halide, r is an integer of from 1 to 3, and q is 3.

23. The method of claim 20 wherein said gold-containing chemical sensitizing compound is a gold(III)-containing chemical sensitizing compound that is represented by the following Structure GOLD:

$Au(III)L'_rY_q$

GOLD wherein L' represents the same or different ligands, each ligand comprising at least one heteroatom that is capable of forming a bond with gold, Y is an anion, r is an integer of from 1 to 8, and q is an integer of from 0 to 3.

24. The method of claim 11 further comprising adding one or more spectral sensitizing dyes to said photosensitive dispersion.

25. A method for making a photothermographic emulsion comprises the steps of, in order:

A) forming photosensitive silver halide grains in the presence of a hydroxytetrazaindene or an N-heterocyclic compound having at least one mercapto group, B) forming a photosensitive dispersion of said photosensitive silver halide grains with a non-photosensitive source of reducible silver ions in a non-aqueous medium, and C) chemically sensitizing said photosensitive silver halide grains with at least one sulfur-containing, tellurium-containing, or gold-containing chemical sensitizing compound, or mixture thereof, to form a chemically sensitized photosensitive dispersion.

26. The method of claim 24 wherein said photosensitive silver halide grains are chemically sensitized with at least one sulfur-containing or tellurium-containing chemical sensitizing compound, or both, in combination with a gold(III)-containing chemical sensitizing compound.

27. A method for making a photothermographic emulsion comprising the steps of:

A) forming photosensitive silver halide grains in the presence of a hydroxytetrazaindene or an N-heterocyclic compound comprising at least one mercapto group, B) forming a photosensitive dispersion of said photosensitive silver halide grains with a non-photosensitive source of reducible silver ions in a non-aqueous medium, and C) after step A and prior to step B, chemically sensitizing said photosensitive silver halide grains with at least one sulfur-containing, tellurium-containing, or gold-containing chemical sensitizing compound, or a mixture thereof.

28. A method for making a photothermographic emulsion comprising the steps of:

A) precipitating photosensitive silver halide grains in the presence of a hydroxytetrazaindene or an N-heterocyclic compound comprising at least one mercapto group, B) combining said photosensitive silver halide grains with a non-photosensitive source of reducible silver ions, a reducing agent for said reducible silver ions, and a hydrophobic binder to form a photosensitive dispersion, and C) after step A, chemically sensitizing said photosensitive silver halide grains with at least one sulfur-containing, tellurium-containing, or gold-containing chemical sensitizing compound, or mixture thereof.

29. The method of claim 28 wherein step C is carried out after step B, and said method further comprises:

D) adding one or more spectral sensitizing dyes to said photosensitive dispersion.

30. The method of claim 28 further comprising adding the same or different hydroxytetrazaindene or mercapto-substituted N-heterocyclic compound to said photosensitive dispersion after step B.

31. A method for making a photothermographic emulsion comprising the steps of:

A) providing photosensitive silver halide grains that have been formed in the presence of a hydroxytetrazaindene or an N-heterocyclic compound comprising at least one mercapto group, and B) forming a non-photosensitive source of reducible silver ions in the presence of said photosensitive silver halide grains, thereby forming a photosensitive dispersion.

32. A method for making a photothermographic emulsion comprising the steps of A) providing photosensitive silver halide grains that have been formed in the presence of a hydroxytetrazaindene or an N-heterocyclic compound comprising at least one mercapto group, B) forming a non-photosensitive source of reducible silver ions in the presence of said photosensitive silver halide grains, thereby forming a photosensitive dispersion, and C) after step A, chemically sensitizing said photosensitive silver halide grains with at least one sulfur-containing, tellurium-containing, or gold-containing chemical sensitizing compound, or mixtures thereof.

33. A method of providing a photothermographic material comprising applying the chemically-sensitized photosensitive dispersion of claim 1 as a photothermographic emulsion to a support.

* * * * *